US006860390B2

(12) United States Patent
Bowman

(10) Patent No.: US 6,860,390 B2
(45) Date of Patent: Mar. 1, 2005

(54) MEDICINE ORGANIZER DEVICE

(76) Inventor: William Kenneth Bowman, 207 Pine Dr., Moon Township, PA (US) 15108

( * ) Notice: Subject to any disclaimer, the term of this patent is extended or adjusted under 35 U.S.C. 154(b) by 196 days.

(21) Appl. No.: 10/076,297

(22) Filed: Feb. 14, 2002

(65) Prior Publication Data

US 2002/0121453 A1 Sep. 5, 2002

Related U.S. Application Data

(60) Provisional application No. 60/275,537, filed on Feb. 20, 2001.

(51) Int. Cl.[7] ..... B65D 83/04
(52) U.S. Cl. ..... 206/534; 206/538
(58) Field of Search ..... 206/528, 534, 206/538, 539, 540, 459.5; 40/310; 190/100, 109

(56) References Cited

U.S. PATENT DOCUMENTS 4,126,247 A 11/1978 Majka
4,318,477 A * 3/1982 Kerpe ..... 206/534
4,389,963 A * 6/1983 Pearson ..... 206/459.5
4,573,580 A 3/1986 Messer
4,573,606 A 3/1986 Lewis
4,593,819 A * 6/1986 Will ..... 206/534
4,749,085 A * 6/1988 Denney ..... 206/534
4,763,810 A 8/1988 Christiansen
4,889,237 A * 12/1989 Brandon ..... 206/534
4,972,657 A * 11/1990 McKee ..... 206/534
4,976,351 A * 12/1990 Mangini et al. ..... 206/534
5,762,199 A 6/1998 Aguilera
5,915,560 A 6/1999 George et al.
6,193,103 B1 2/2001 Clarijs
6,338,535 B1 1/2002 Rickert
6,464,506 B1 * 10/2002 Welles ..... 206/534

* cited by examiner

*Primary Examiner*—Luan K. Bui
(74) *Attorney, Agent, or Firm*—John Dodds

(57) ABSTRACT

This invention allows medications to be held in bottles in a "medicine organizer device" in such a way that all medications can be identified and taken by the user easily and safely and at the appropriate time. It minimizes the risks associated with forgetting to take medication. The invention facilitates direct transfer of the appropriate dosage of medicine to the patient's mouth without the need of hand contact that in addition to sanitary considerations can lead to dropping the medication before oral ingestion.

9 Claims, 6 Drawing Sheets

MEDICINE ORGANIZER DEVICE

CROSS REFERENCES TO RELATED APPLICATIONS

This application is entitled to benefit of Provisional Patent Application Ser. No. 60/275,537 filed Feb. 20, 2001.

FEDERALY SPONSORED RESEARCH

This research was not sponsored by any Federal Agency.

REFERENCE TO MICROFICHE APPLICATION

Not applicable to this invention.

BACKGROUND

1. Field of Invention

This invention relates to devices for storing and dispensing medications.

2. Discussion of Prior Art

There are several medicine organizers and pill dispensers present in the prior art, but none of which disclose the invention that pertains to this application. U.S. Pat. No. 4,126,247 (Majka, 1978) describes a pill dispenser which is a key operated device and does not let the user put bottles with medicine, unlike the Bowman invention. U.S. Pat. No. 4,573,606 (Lewis, 1986) discloses an automatic pill dispenser and method of administering medical pills, which has a photoelectric pill detector, yet does not foresee handling of bottles with medication. U.S. Pat. No. 4,573,580 (Messer, 1986) pertains to a unit dose medication dispenser where the user consumes medicine by hand and no bottle handling is foreseen. U.S. Pat. No. 4,763,810 (Christiansen, 1988) relates to a medication dispenser that has a microprocessor and does not foreseen handling of bottles of medication. U.S. Pat. No. 5,762,199 (Aguilera, 1988) refers to a daily pocket pill organizer that is a compartmented pocket size cylindrical dispenser of pills with a removable top. U.S. Pat. No. 5,915,560 (George et al, 1999) describes a compartmentalized pill dispenser with a plurality of pill cavities but that does not involve bottle handling. U.S. Pat. No. 6,193,103 (Clarijs, 2001) discloses a pill dispenser with a base plate, a cover, holding means for pills and aperture for releasing pill, but no handling of medicine bottles. Finally, U.S. Pat. No. 6,338,535 (Rickert, 2002) relates to a pill organizer with a plurality of drawers but using no medicine bottles. Therefore, the prior art does not include a medicine organizer device in which the user can consume the medication directly from a bottle containing medication. Thus, this invention prevents the user's direct hand contact with the medicine, dropping the medication to the ground, and sanitary problems. For all of these reasons, the Bowman invention is a new and useful device subject to patent protection.

SUMMARY

This invention allows medications to be held in bottles in a "medicine organizer device" in such a way that all medications can be identified and taken by the user easily and safely and at the appropriate time. It minimizes the risks associated with forgetting to take medication or multiple dosing because of forgetfulness of the patient, lack of communication skills, oversight on a caregivers part or other form of negligence to timeliness or dosage. Furthermore the invention facilitates direct transfer of the appropriate dosage of medicine to the patient's mouth without the need of hand contact that in addition to sanitary considerations can lead to dropping the medication before oral ingestion.

OBJECTS & ADVANTAGES

This invention offers a number of useful advantages over other mechanisms for dispensing and assisting in timely oral delivery of medications. These advantages include:

1. Improved Sanitary Status. The medication does not have to make contact with the patient's hand before oral ingestion. The bottle can be raised directly to the patient's mouth and the medication ingested directly from the bottle.
2. Improved safety during the ingestion process. It is not uncommon for persons taking hand held medications to drop pills on the floor in the process of passing them to the mouth. Placing the bottle of medication to the lips and tilting the bottle upside down pouring the medication directly into the mouth, avoiding the risk of loss.
3. The prevention of pills falling on the floor has the additional safety feature that this minimizes risk of children or pets consuming medication that has fallen to the floor.
4. This invention is particularly useful for those patients that are visually impaired since pre dispensed medication does not need to be counted etc.

DESCRIPTION OF INVENTION

Figure 6:
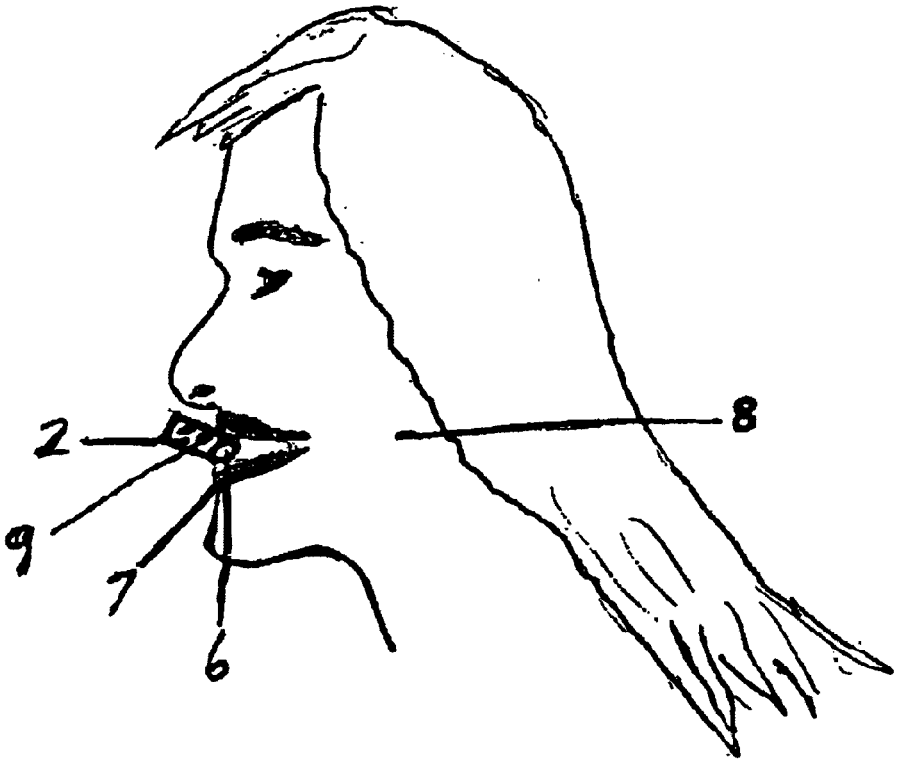
FIG. 6 shows a patient taking one time medication portion of a bottle. The opening of the bottle is so designed that it fits in between of the sealed lips of the patient thereby preventing spill over. In this embodiment the medication is liquid.

The invention consists of a device for holding small tubes (1) or bottles (2) with caps (3). This holding device may be tray like in form or a small box or briefcase (4) form. The bottles or capped tubes are arranged in a sequential order so as to allow for various combinations of delivery times for the medication in the tubes. These slots can be labeled as appropriate to cover different days or different times within an individual day. On a fixed time basis, i.e. weekly or monthly, the individual bottles are filled with the appropriate dosage of medication. The bottles are then arranged in the bottle holding device. At the appropriate times the patient, or one that is to administer the medicine, removes a tube or bottle, uncaps it and transfers it to the mouth. Once the neck of the bottle is in the mouth it is tilted so as to transfer the medication directly from the tube (1) or the bottle (2) to the mouth as shown in FIG. 6.

The empty bottle is then returned to the carrier upside down, serving as a record to all concerned that the medication has been ingested.

OPERATION OF INVENTION

The invention consists of a box, case, or other device for holding a series of tubes (1) or bottles (2) forming a medicine-dispensing device. The bottles (2) are arranged in the holding device in a specific array that allows for fixing a schedule to take medications on a regular timeframe. At the appropriate time individual bottles (2) are removed, uncapped and the bottle is passed so that the opening (6) is placed between sealed lips (7) of the patients (8). The patient (8) then tilts the bottle (2) in such a way as to cause the medication (9) to be ingested into the mouth, without risk of spillage.

Figure 1:
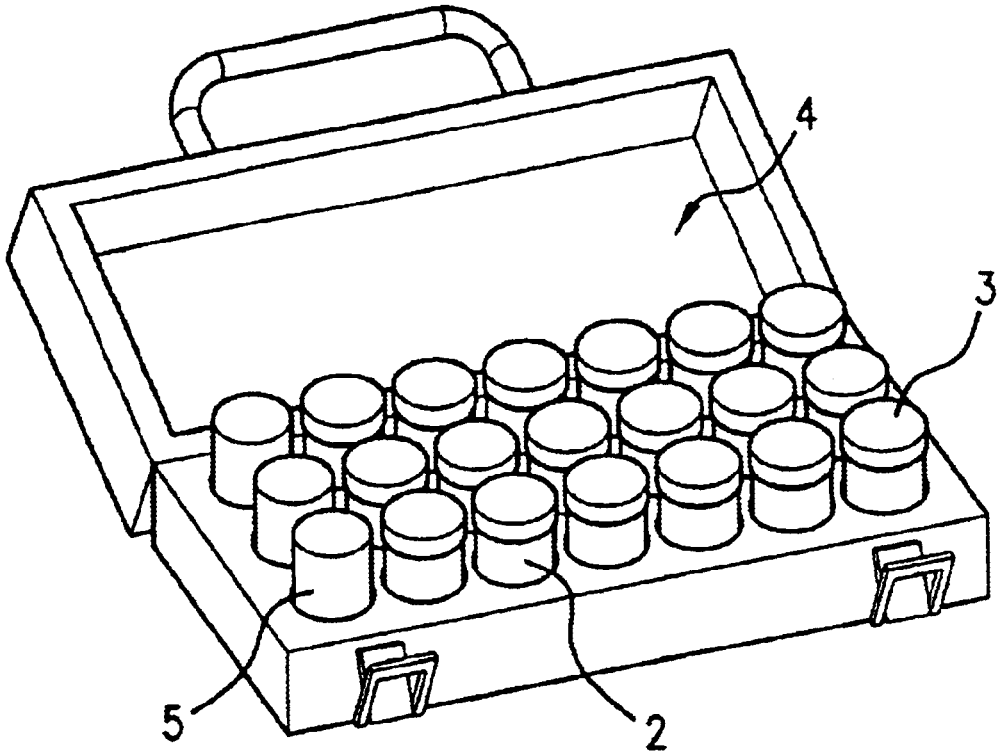
FIG. 1 is a view of the medication organizer device with capped bottles containing one time medication portion and empty bottles being attached to the device up side down to indicate that the medication has been taken.
Figure 2:
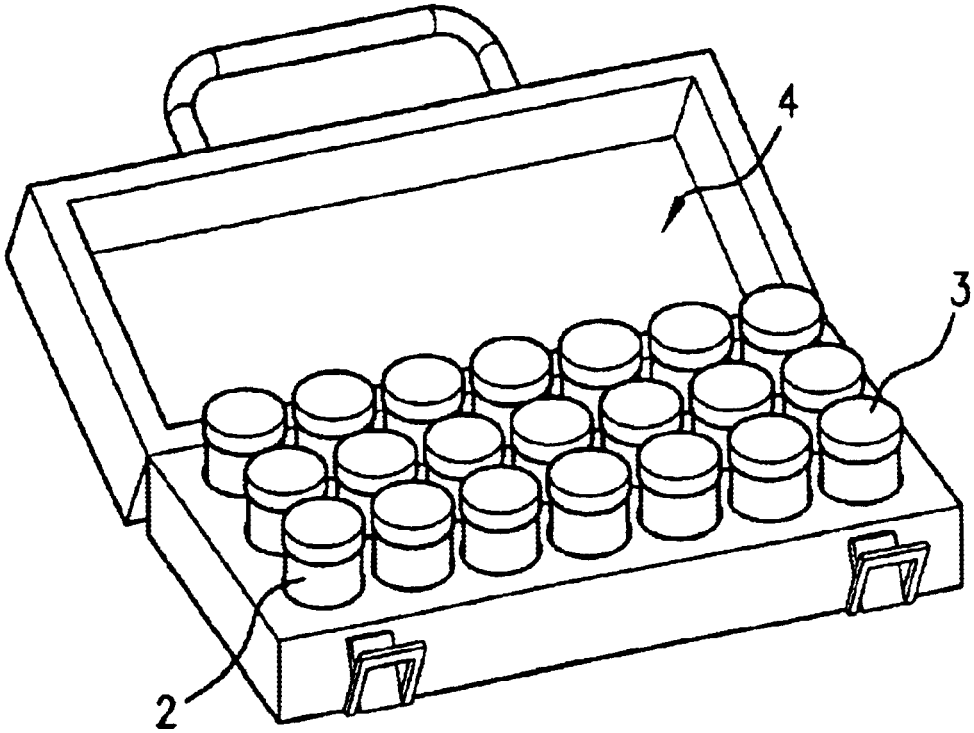
FIG. 2 is a view of the medication organizer device for a patient with capped bottles each containing a one time medication portion.
Figure 3:
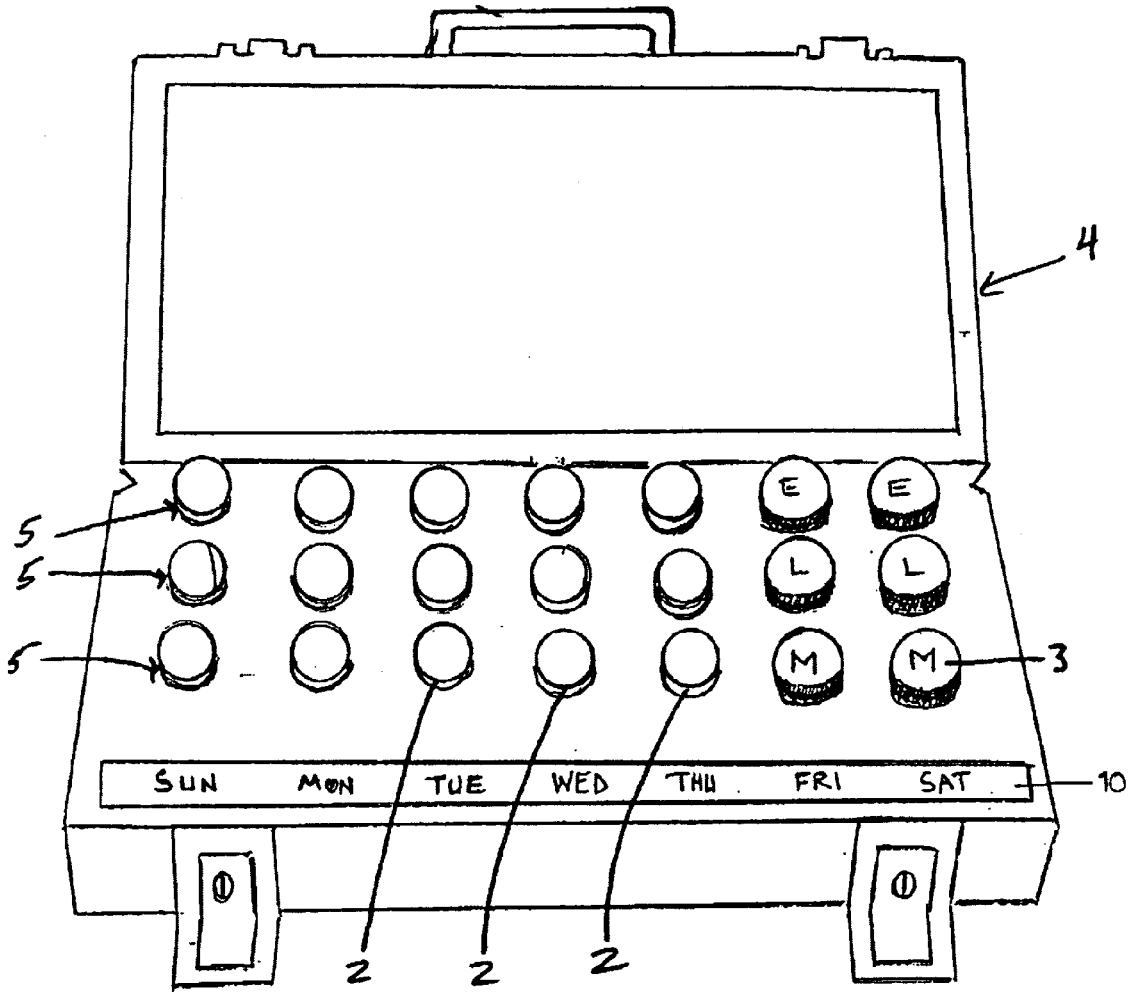
FIG. 3. is a view of the medication organizer device with capped bottles containing one time medication portion and empty bottles being attached to the device up side down to indicate that the medication has been taken. The bottle caps are marked indicating the time of the day content of each bottle is meant to be taken. The holding device contains labels for each day the medication is to be taken.
Figure 4:
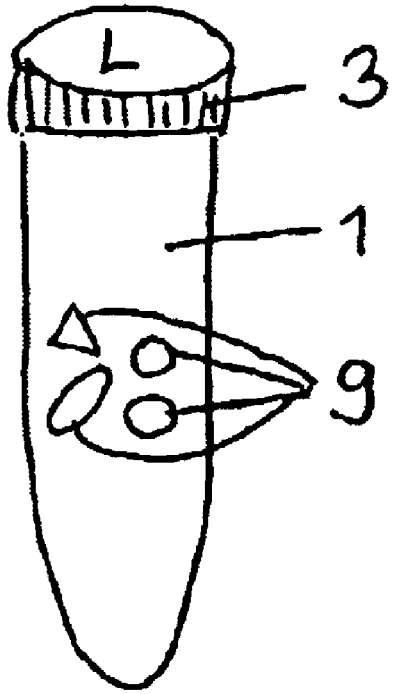
FIG. 4 is a side view of a capped bottle containing a one time medication. The cap has a label as to the time of the day the medication is to be taken.
Figure 5:
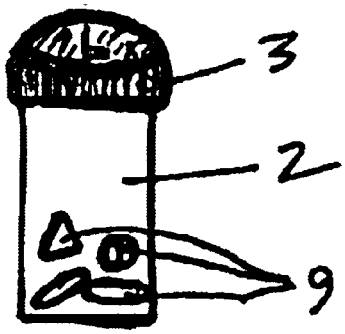
FIG. 5 is a side view of a capped tube containing a one time medication. The cap has a label as to the time of the day the medication is to be taken.
Figure 5:
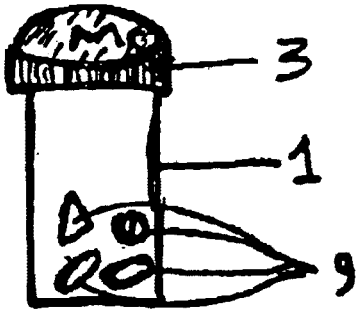

The device will be deployed with a labeling system (10) so that bottles can be located and or labeled either by day or time of day. This might include, but is not limited to "morning", "lunch" and "evening". FIG. 3 shows an example of the labelings.

DESCRIPTION AND OPERATION OF ALTERNATIVE EMBODIMENTS

The drawings represent an embodiment of the device. The scope of the device is however limited only by the scope of the claims not by a particular embodiment shown in the drawings. Among the various embodiments are included varying carrying devises such as cases, boxes, and flats. Also envisaged are various color code or labeling embodiments for the bottles. It is envisaged that after the medication has been taken the bottle (2) or tube (1) can be returned to the carrying device in an inverted position. By having the empty bottles downside (5) it can be easily determined which medications have been ingested.

CONCLUSION, RAMIFICATION & SCOPE OF INVENTION

Although the description above contains much specificity, these should not be construed as limiting the scope of the invention but as merely illustrations of some of the presently preferred embodiments of this invention. Thus, the scope of the invention should be determined by the appended claims and their legal equivalents, rather than by the examples given.

I claim:

1. A medicine organizer device comprising:

A holding device for a plurality of medicine containers to be arranged in a sequential order, said holding device further being in a form of a briefcase;

plurality of containers having a cap covering an opening, said containers being capable of holding an one time medication portion of a user, said containers being further attached right side up to said holding device when containing the one time medication portion, said containers being attached right side down to said holding device when empty, said opening being sized so that it can be placed fully in between lips of the user to ingest the one time medication portion by tilting the container, thereby eliminating the risk of dropping or spilling the one time medication portion placed inside said container;

and a labeling system enabling recognition of each container arranged in the device.

2. The medicine organizer device claimed in claim 1 wherein the medicine containers are bottles.

3. The medicine organizer device claimed in claim 1 wherein the medicine containers are capped tubes.

4. The medicine organizer device claimed in claim 1 wherein the medicine containers allow liquid medicine to be stored therein.

5. The medicine organizer device claimed in claim 1 wherein the medicine containers allow solid medicine to be stored therein.

6. The medicine organizer device claimed in claim 1 wherein the labeling system includes labels to be attached on the containers to indicate individual days.

7. The medicine organizer device claimed in claim 1 wherein the labeling system includes labels to be attached on the containers for different times of a day.

8. The medicine organizer device claimed in claim 7 wherein the labels allows the containers to be labeled in a time frame "morning", "lunch" and "evening".

9. The medicine organizer claimed in claim 1 wherein the labeling system comprises color codes in the containers to indicate a specific time of consumption of the medicine.

* * * * *